US012049745B1

(12) United States Patent
Cotugno

(10) Patent No.: US 12,049,745 B1
(45) Date of Patent: Jul. 30, 2024

(54) UNIVERSAL CURB VALVE CRADLE WITH IMPROVED ALIGNMENT RETENTION

(71) Applicant: James R. Cotugno, Baltimore, OH (US)

(72) Inventor: James R. Cotugno, Baltimore, OH (US)

( * ) Notice: Subject to any disclaimer, the term of this patent is extended or adjusted under 35 U.S.C. 154(b) by 0 days.

(21) Appl. No.: 18/141,638

(22) Filed: May 1, 2023

(51) Int. Cl.
*E03B 9/10* (2006.01)
*E03B 9/08* (2006.01)

(52) U.S. Cl.
CPC ..... *E03B 9/08* (2013.01); *E03B 9/10* (2013.01); *Y10T 137/6999* (2015.04); *Y10T 137/7002* (2015.04)

(58) Field of Classification Search
CPC ..... E03B 9/08; E03B 9/10; E03B 9/12; Y10T 137/6999; Y10T 137/7002; Y10T 137/7006
USPC ..... 220/8
See application file for complete search history.

(56) References Cited

U.S. PATENT DOCUMENTS 1,578,885 A * 3/1926 Flinn ..... E03B 9/10 220/3.92
2,691,384 A * 10/1954 Mueller ..... E03B 9/10 220/3.7
4,245,753 A * 1/1981 Ellis ..... B44D 3/127 215/318
4,331,178 A * 5/1982 Handley ..... F16K 27/006 251/293
5,680,949 A * 10/1997 Roesler ..... B65D 85/20 220/8
2006/0254649 A1 11/2006 Cotugno et al.

* cited by examiner

*Primary Examiner* — Kevin F Murphy
(74) *Attorney, Agent, or Firm* — Frank H. Foster; Kremblas & Foster

(57) ABSTRACT

A curb valve cradle for maintaining operable access to the operating nut of a curb valve with a valve key wrench tool. The cradle has a pair of spaced-apart upstanding arms connected together by a base. Each arm has multiple stop ridges arranged in a vertical series along opposite interfacing surfaces of the arms. A retaining ring with a central opening is matingly slidable between and along the upstanding arms. The retaining ring has a peripheral latch flange protruding radially outward and engageable with the stop ridges. The latch flange and stop ridges are configured to permit the ring to be slid downward between the upstanding arms from the top free ends of the arms and pass the stop ridges and to resist or prevent the ring from being slid upward past the stop ridges.

10 Claims, 4 Drawing Sheets

Fig. 1
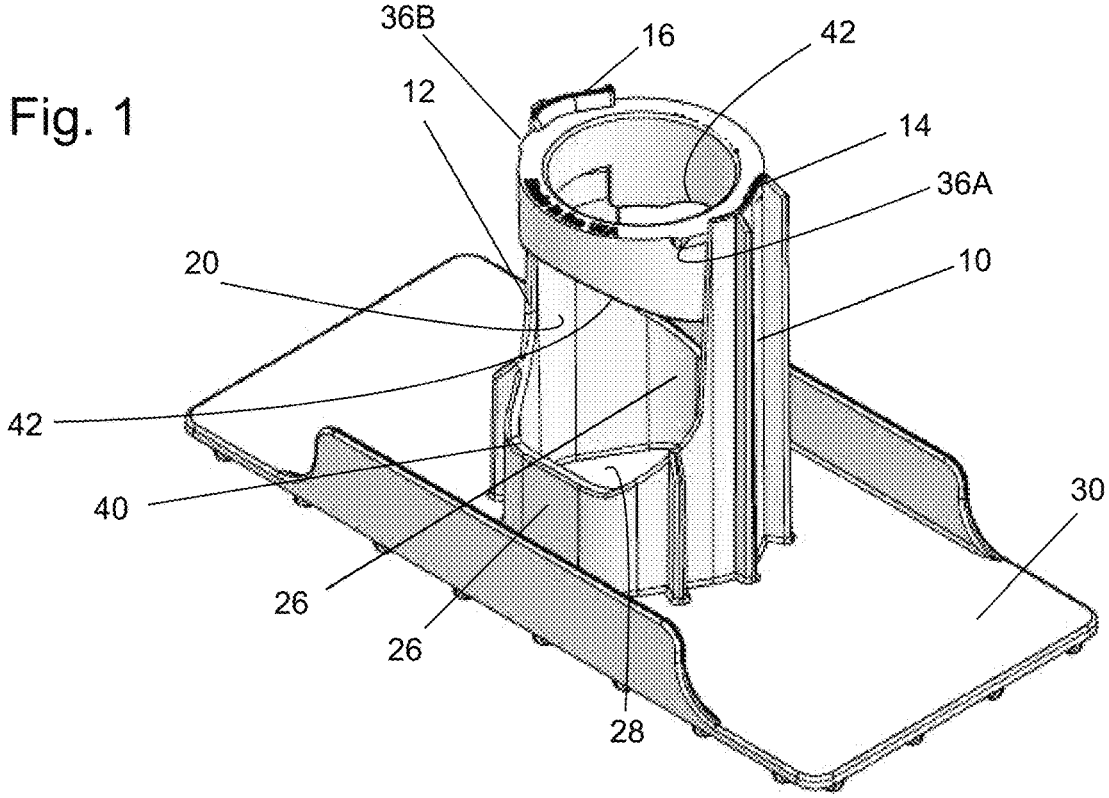
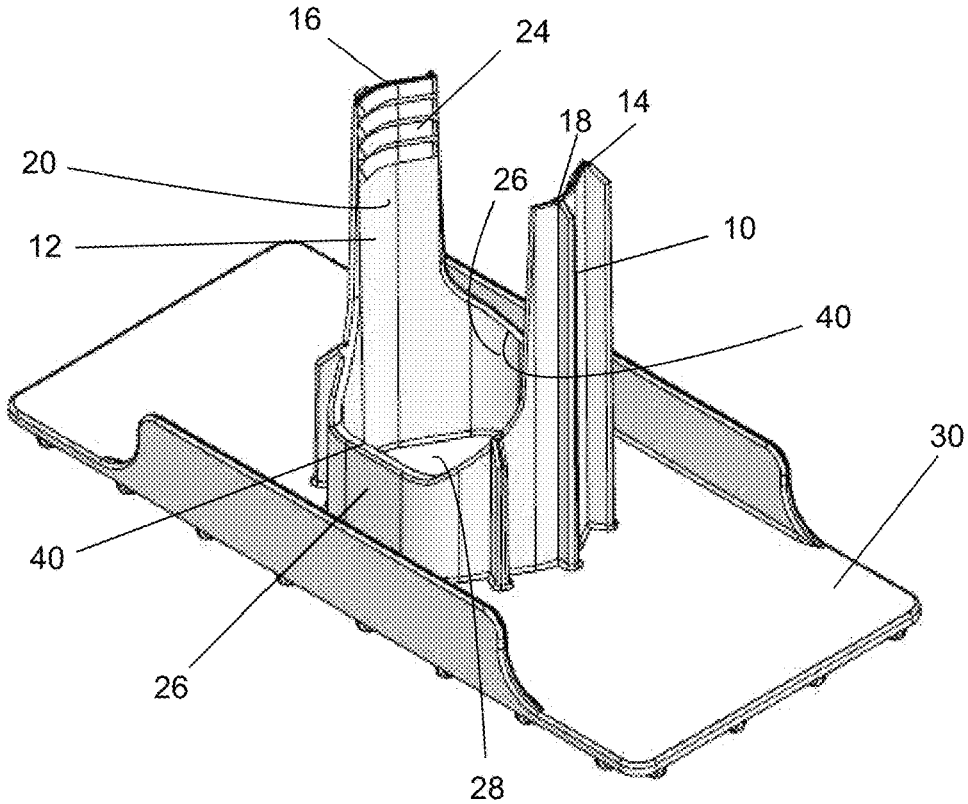
Fig. 2

UNIVERSAL CURB VALVE CRADLE WITH IMPROVED ALIGNMENT RETENTION

BACKGROUND OF THE INVENTION

This invention relates to public water supply system hardware and more particularly is directed to a universal cradle with structural features for improving the retention of the alignment of a water main curb valve in a curb box after they are installed underground. Sufficient alignment is maintained to allow a curb valve key wrench tool to be inserted through the curb box and its socket to engage the operating nut of the valve so that the valve can be operated.

In a water supply connection of a water main to a particular water customer, a water main curb valve is installed underground near the water main. The curb valve is interposed between a pipe that connects to the water main and a supply pipe that connects to a customer's water system. The curb valve is a service shutoff valve that allows the water supply to the customer to be turned on or off in an emergency or for other reasons. In order to provide an access point for operating the valve without requiring excavation, a curb box, (aka riser pipe and service box) is installed that extends from the buried curb valve upward to the ground or pavement surface. A common practice is to support the curb valve and curb box on a brick or board which distributes their weight and helps maintain the initial positioning of the curb box and the valve.

As long as the curb box and the valve remain in their original positions and orientations, a curb valve key wrench tool can be inserted down into and through the curb box and its mating socket end can be engaged onto the curb valve operating nut at the top of the valve stem. Unfortunately, with the passage of time the ground often shifts and changes the position and/or the orientation of the valve or curb box or both. These changes sometimes cause rotation of the valve and resulting misalignment of the valve with the curb box. The misalignment can prevent the key wrench tool from engaging the operating nut.

In order to prevent this misalignment, the prior art has shown a variety of structures referred to as a base, a support or a centering or positioning device. One such device is a cradle that is described in my prior patent application which is herein incorporated by reference (application Ser. No. 11/432,641, published as Pub. No. 2006/0254649). My application and the prior art that was cited in its prosecution explain in more detail the problems that led to development of those prior art devices.

However, despite the improvement provided by my above cradle, a problem was still encountered with a retaining ring used with that cradle to further restrain the valve against rotation and resulting misalignment. I have discovered that mud, which surrounds an installed curb box, valve and cradle, can flow into the curb box and under the ring despite its high viscosity. The flowing mud can then push the ring upward. When the ring rises above its initial installed position seated on the valve, the ring can become a barrier that prevents the socket of a curb valve key wrench tool from engaging the valve's operating nut. A part of the ring can get repositioned against or close to the operating nut leaving no space for the tool's socket to slide down along the sides of the operating nut. In that way the ring becomes a barrier that blocks the tool from engaging the operating nut. The result is that the valve cannot be operated by the tool which defeats the purpose of installing a curb box. Excavation becomes necessary.

Therefore, an object and feature of the present invention is to prevent such a ring from being pushed up above its initial installed position seated against the valve.

A further object and feature of the invention is to provide multiple levels at which the ring can be retained against being raised in order to permit universal use of the cradle for valves of differing sizes.

SUMMARY OF THE INVENTION

The invention is a curb valve cradle for maintaining operable access to the operating nut of a curb valve with a valve key wrench tool. The cradle is configured to prevent mud and debris in which the curb valve and cradle are buried from lifting a ring that extends around the neck of the curb valve. This configuration prevents the ring from rising up to a position where it no longer is able to prevent the curb valve from rotating into a misalignment with a curb box. By retaining the ring in its original installed position, the ring continues to prevent rotation of the valve despite upward pressure from surrounding mud. In that way the invention maintains access for a curb valve key wrench tool to engage the valve's operating nut.

The cradle has a pair of spaced-apart upstanding arms each having a free top end and connected together by a base. The arms each having multiple stop ridges arranged in a vertical series along opposite interfacing surfaces of the arms. A retaining ring with a central opening is matingly slidable down between and along the upstanding arms. The retaining ring has a peripheral latch flange protruding radially outward and engageable with the stop ridges. The latch flange engagement with the stop ridges permits the ring to be slid downward between the upstanding arms and pass by stop ridges but prevents the ring from being slid upward past stop ridges.

The stop ridges are transverse to the upstanding arms and are preferably horizontal with a barb profile. The stop ridges are configured and oriented with their stop direction being upward and their pass direction being downward. Preferably the latch flange has a mating barb configuration with its stop direction being upward.

BRIEF DESCRIPTION OF THE DRAWINGS

FIG. 1 is a view in perspective of a preferred embodiment of the invention with its retention ring in an upper position.

FIG. 2 is a view in perspective of the preferred embodiment of FIG. 1 but without its retention ring.

Figure 3:
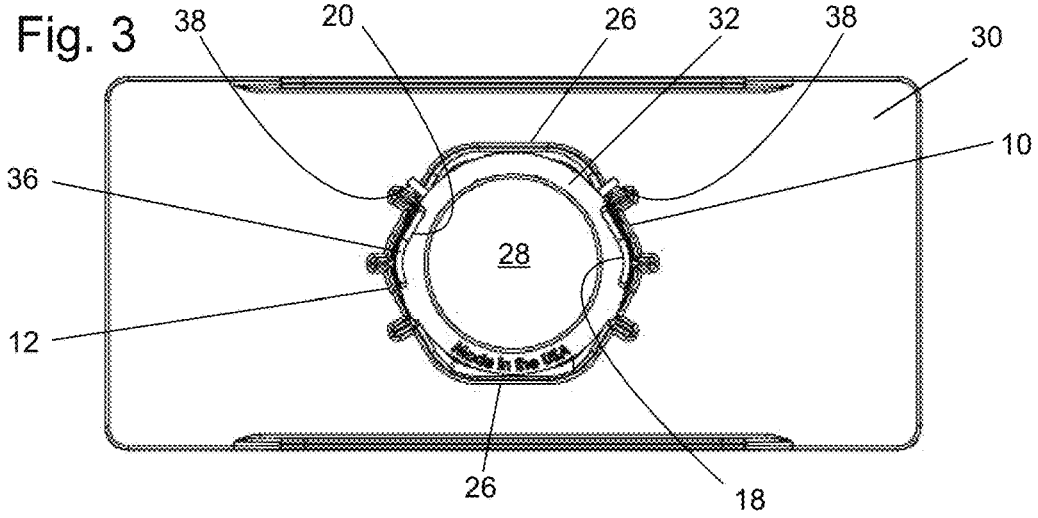
FIG. 3 is a top view of the embodiment as illustrated in FIG. 1.
Figure 4:
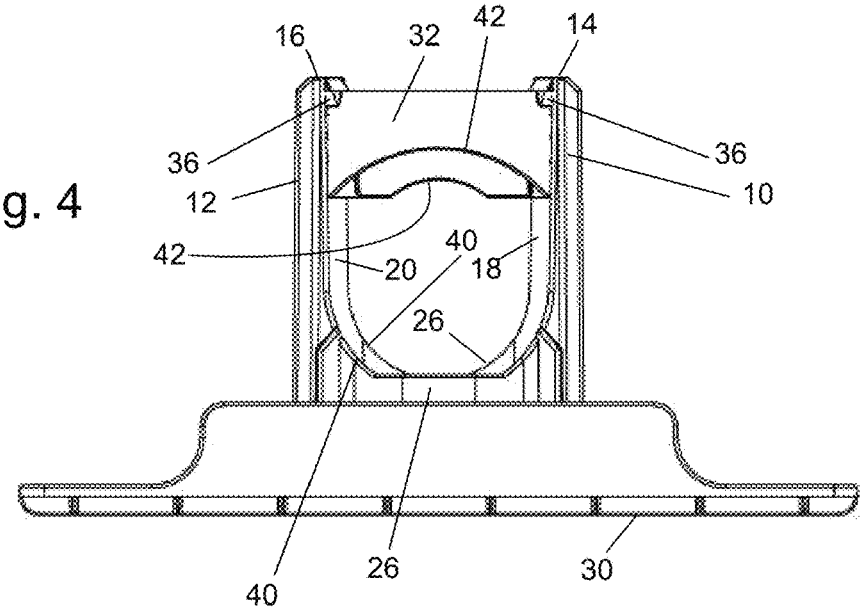
FIG. 4 is a front view of the embodiment as illustrated in FIG. 1.
Figure 5:
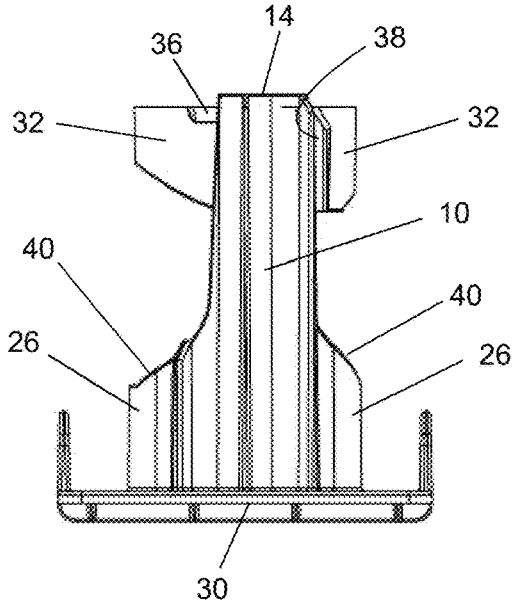
FIG. 5 is a side view of the embodiment as illustrated in FIG. 1, the opposite side view being a mirror image thereof.
Figure 6:
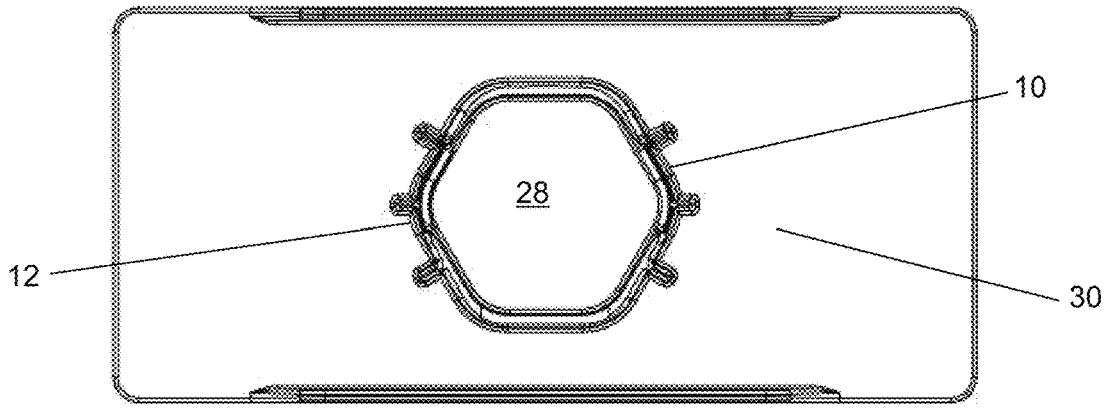
FIG. 6 is a top view of the embodiment as illustrated in FIG. 2.
Figure 7:
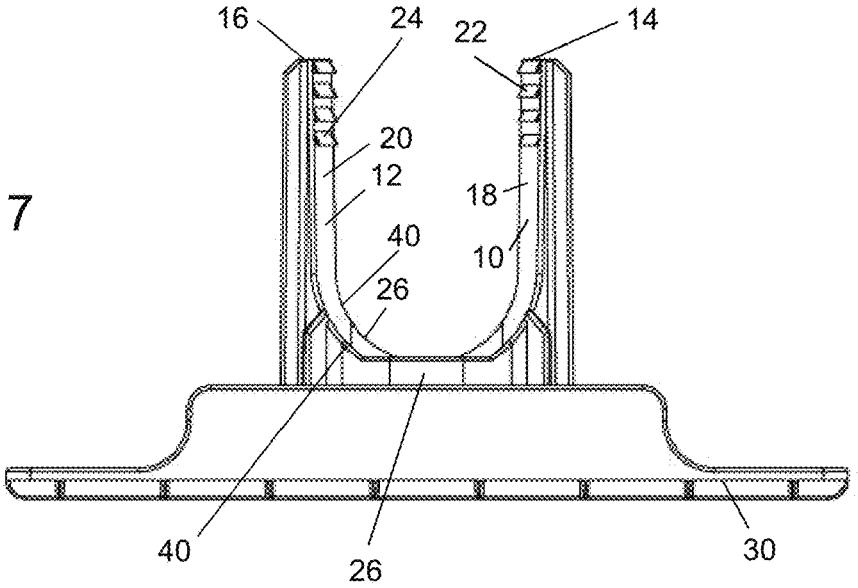
FIG. 7 is a front view of the embodiment as illustrated in FIG. 2.
Figure 8:
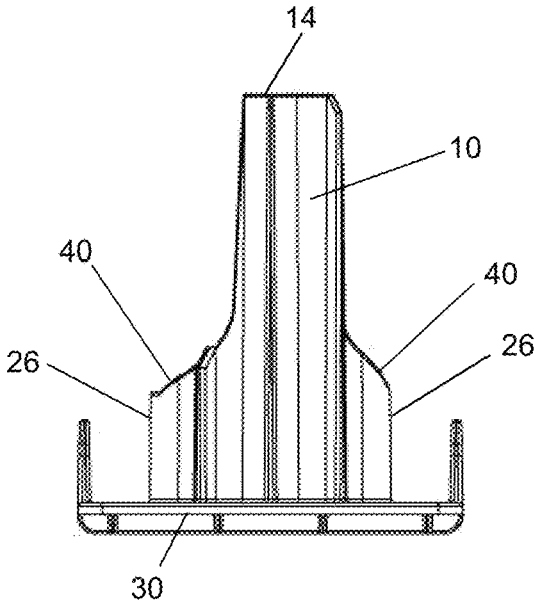
FIG. 8 is a side view of the embodiment as illustrated in FIG. 2, the opposite side view being a mirror image thereof.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose.

DETAILED DESCRIPTION OF THE INVENTION

In order to facilitate this description, the invention is described as it is oriented in its installed and operable orientation in the ground. Examples of such terminology include use of the words top, vertical, horizontal, upstanding, upward, downward and lift.

The invention is a curb valve cradle for maintaining operable access to the operating nut of a curb valve with a valve key wrench tool. Referring to the Figures, particularly FIGS. 1 and 2, the cradle has a pair of spaced-apart, upstanding arms 10 and 12. Each arm has a free top end 14, 16. Preferably, the interior interfacing surfaces 18 and 20 of the arms 10, 12 are arcuate surfaces 18, 20 along at least an upper portion of the arms 10, 12. Those interfacing surfaces 18, 20 fall along a circle that has a vertical axis and has a radius substantially equal to the radius of the periphery of the retention ring that is described below. The interfacing interior walls of the arms 10, 12 are preferably mirror images of each other and are positioned either diametrically opposite each other or slightly angularly offset from diametrically opposite each other so that the distance between their vertical edges are slightly larger on one side than on the other. Upstanding arms 10, 12 are connected together by a base.

The arms 10, 12 are attached to the base that holds the arms 10, 12 together and upright. The base can comprise as little as only the bottom ends of the arms 10, 12 and the bottom ends of a pair of webs 26 that connect the arms 10, 12 together. Alternatively, the base can additionally include a panel (like an end cap) that joins together the bottoms of the arms 10, 12 and the webs 26. Preferably, however, the base includes a planar plate 30. The planar plate 30 is connected to and joins together the bottoms of the arms 10, 12 and the webs 26 and also extends outward from the arms 10, 12 and the webs 26 to provide better stability.

Importantly, the arms 10, 12 each have multiple stop ridges 22, 24 that are arranged in a vertical series along the opposite interfacing surfaces 18, 20 of the arms 10, 12. The series of stop ridges 22, 24 extend downward from the top 14, 16 of each arm 10, 12. The stop ridges 22, 24 are transverse to the upstanding arms 10, 12 and preferably are perpendicular to the upstanding arms 10, 12 (horizontal in the operable orientation).

The preferred stop ridges 22, 24 have a barb profile and are oriented with their stop direction being upward. They are a series of serrations protruding from the underlying interfacing surfaces 18, 20. Each individual ridge has two intersecting surfaces. One surface has a relatively low slope that operates as a ramp over and along which another object, such as a ridge or flange, can slide relatively easily. The other serration surface has a very high slope which blocks movement in the opposite direction. Consequently, the barb profile has a stop direction and an opposite pass direction. Of course there are other configurations that can be used for the stop ridges. For example, the interior interfacing surfaces of the arms can be formed with a spaced series of transverse or horizontal slots separated by raised surfaces. A flange or ridge would seat into opposite slots to inhibit vertical movement of a flange or ridge and a body attached to the flange or ridge. The prior art undoubtedly discloses other cooperating configurations that would similarly inhibit movement in an upward vertical direction.

Figure 9:
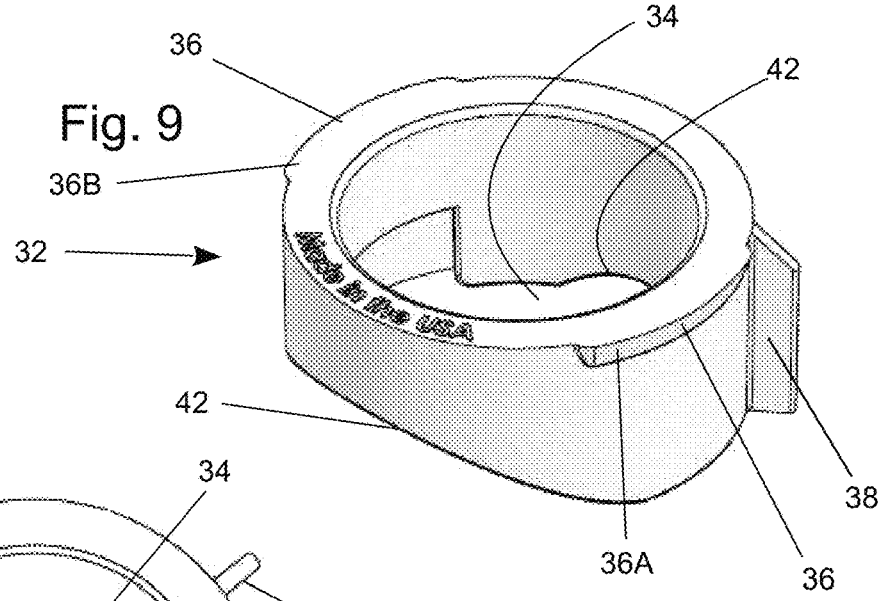
FIG. 9 is a view in perspective of the retention ring of the preferred embodiment of the invention.
Figure 10:
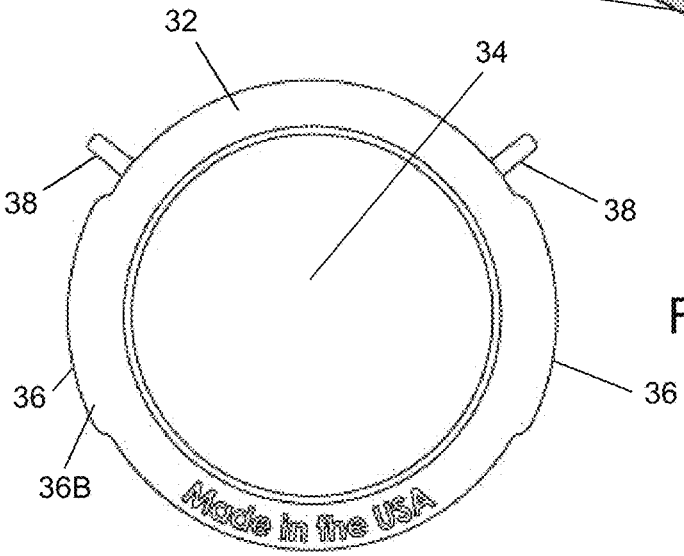
FIG. 10 is a top view of the retention ring illustrated in FIG. 9.
Figure 11:
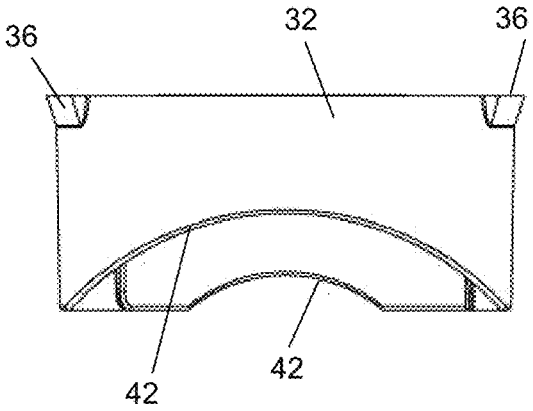
FIG. 11 is a front view of the retention ring illustrated in FIG. 9.
Figure 12:
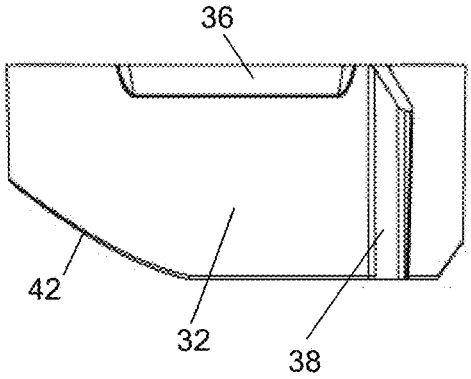
FIG. 12 is a side view of the retention ring illustrated in FIG. 9, the opposite side view being a mirror image thereof.

FIGS. 9 through 12 illustrate a preferred retaining ring 32. The retaining ring 32 has a circular central opening 34 and is matingly slidable between and along the upstanding arms 10, 12. The central opening 34 must be at least large enough to allow the socket of a curb valve key wrench tool to pass through the opening 34 and onto the valve's operating nut. The retaining ring 32 has a peripheral latch flange 36 protruding radially outward and engageable with the stop ridges 22, 24. The latch flange 36 and the stop ridges 22, 24 are configured to permit the retaining ring 32 to be slid downward between the upstanding arms from their free top ends 14 and 16 and pass the stop ridges 22, 24 and to resist or prevent the ring from sliding upward past the stop ridges 22, 24.

The latch flange 36 can be a single latch flange that continuously surrounds the entire periphery of the retaining ring 32. As another alternative it can comprise a series of spaced-apart latch flanges that surround a part or all of the periphery of the ring 32. Preferably, however, the latch flange 36 comprises a pair of discrete latch flanges 36A and 36B that protrude radially outward in opposite or nearly opposite directions. They are spaced apart circumferentially on the ring by a distance that aligns them for engagement with the stop ridges 22, 24 on the upstanding arms 10, 12.

The preferred configuration of the latch flange is also a barb configuration. The barb configuration is inverted from the barb configuration of the stop ridges 22, 24 and preferably matingly seats against their surfaces. Consequently, the low slope ramp surfaces of the stop ridges 22, 24 face downward and the steep slope stop surface of the latch flange 36 faces upward. As with the configuration of the stop ridges described above, there are alternative configurations for the latch flange 36. The important structural feature of both is that when they engage each other, they provide a stop direction that is upward and a slidable direction that is downward.

The upstanding arms 10, 12 must be resiliently flexible. They have a spring constant that is in a range that permits a person who is installing the cradle to be able to lower the retaining ring 32 down between and along the arms 10, 12 against a valve. Additionally, that spring constant is in a range that allows an installer to spread the legs sufficiently far apart with the installer's fingers to disengage the latch flange from the stop ridges and lift the ring past the stop ridges and out from between the arms. Lifting the ring 32 out from between the arms 10, 12 may be necessary in order to modify an installation or disassemble it. The spring constant must also be in a range that will maintain the stop ridges 22, 24 of the arms 10, 12 functionally engaged against the latch flange 36.

On the preferred embodiment that has the discrete latch flange components 36A and 36B, the retaining ring 32 also has a pair of guide shoulders 38. The guide shoulders 38 extend outward from the periphery of the ring 32. They are oriented and spaced apart so they slide along sides of the arms 10, 12. The guide shoulders 38 prevent rotation of the ring 32 when the ring 32 is between the arms 10, 12.

Installation of the cradle begins in the same manner as installation of the cradle described in my above cited previous patent application. The base 30 that is illustrated in FIG. 2 is supported on a suitable foundation, such as the ground level at the bottom of an excavated hole, a brick or a board. The base 30 is supported at a height on the foundation so that its saddle contours 40 on the webs 26 contact the underside of the valve or the underside of the pipes that are connected to the valve. The retaining ring 32 is then slid down between the upstanding arms 10, 12 with the latch flange 36 passing along the stop ridges 22, 24 in the manner of a ratchet until the ring 32 contacts and is stopped by the top side of the valve or the top sides of the pipes that are connected to the valve. Preferably the ring 32 is formed with contoured depressions 42 in diametrically opposite ring undersides for saddling the curb valve or pipes in the same manner as the base component saddles the undersides of the valve or pipes. The saddle depressions 42 on the ring are aligned along an axis that extends between the guide shoulders 38.

A critically important feature of the invention is that both series of stop ridges extend continuously down along a segment of the arms 22, 24 from a selected maximum height at which the ring will contact the largest compatible valve or pipes at least down to a minimum height at which the ring will contact the smallest compatible valve or pipes. The selected maximum height is the position where the latch flange 36 is positioned when the ring 32 contacts the largest compatible valve or pipes and the selected minimum height is the position where the latch flange 36 is positioned when the ring 32 contacts the smallest compatible valve or pipes.

Because multiple stop ridges 22, 24 are continuously distributed along a range of heights, the latch flange 36 of the ring will latch the ring 32 in position at any of a range of heights and prevent any significant rise of the ring after the ring contacts against the valve or pipes. Consequently, the cradle is universal in the sense that it will be latched against being pushed upward for a wide range of valve sizes.

REFERENCE NUMBERS

10, 12 upstanding arms
14, 16 top ends of arms
18, 20 interfacing, interior surfaces of arms
22, 24 series of stop ridges
26 webs connecting arms
28 panel connecting webs and arms
30 planar plate base
32 retaining ring
34 central opening of retaining ring
36 latch flange
36A discrete latch flange component
36B opposite discrete latch flange component
38 guide shoulders
40 saddle contours of base
42 saddle contours of ring This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. A curb valve cradle for maintaining operable access to the operating nut of a curb valve with a valve key wrench tool, the cradle, in an operable orientation, comprising:

(a) a pair of spaced-apart upstanding arms each having a free top end and connected together by a base, each arm having multiple stop ridges arranged in a vertical series along opposite interfacing surfaces of the arms, the stop ridges being transverse to the upstanding arms; and (b) a retaining ring having a central opening and matingly slidable between and along the upstanding arms, the retaining ring having a peripheral latch flange protruding radially outward and engageable with the stop ridges, the latch flange and stop ridges being configured to permit the ring to be slid downward between the upstanding arms from their free ends and pass stop ridges and to resist or prevent the ring from being slid upward past stop ridges.

2. A curb valve cradle according to claim 1 wherein the stop ridges are horizontal and have a barb profile, the stop ridges being oriented with their stop direction being upward.

3. A curb valve cradle according to claim 2 wherein the latch flange has a barb configuration with its stop direction being upwardly.

4. A curb valve cradle according to claim 3 wherein the ring further comprises a pair of guide shoulders extending outward from the periphery of the ring and oriented and spaced apart to be slidable along sides of the arms for preventing rotation of the ring when between the arms.

5. A curb valve cradle according to claim 4 wherein the ring has a pair of upward contoured depressions formed into diametrically opposite ring undersides for saddling the curb valve, the depressions being aligned along an axis that extends between the guide shoulders.

6. A curb valve cradle according to claim 5 wherein the latch flange comprises a pair of discrete latch flanges spaced apart circumferentially to engage the stop ridges.

7. A curb valve cradle according to claim 5 wherein the arms are resilient and have a spring constant in a range that permits a person to spread the legs sufficiently far apart to disengage the latch flange from the stop ridges and lift the ring past the stop ridges and out from between the arms.

8. A curb valve cradle according to claim 5 wherein the base is a planar panel which extends beyond the arms.

9. A curb valve cradle according to claim 1 wherein the latch flange extends circumferentially and continuously around the entire ring.

10. A curb valve cradle according to claim 1 wherein the latch flange is formed in spaced segments around the entire ring, the segments being spaced apart by a distance less than the length of the stop ridges.

* * * * *